US007624481B2

(12) United States Patent
Iwase et al.

(10) Patent No.: US 7,624,481 B2
(45) Date of Patent: Dec. 1, 2009

(54) SLIDER FOR SLIDE FASTENER HAVING A SPRING BODY MOUNTED THEREON

(75) Inventors: Yuichi Iwase, Toyama-ken (JP); Keiichi Keyaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/037,150

(22) Filed: Feb. 26, 2008

(65) Prior Publication Data

US 2008/0148534 A1 Jun. 26, 2008

Related U.S. Application Data

(63) Continuation of application No. 10/831,551, filed on Apr. 23, 2004, now Pat. No. 7,356,887.

(30) Foreign Application Priority Data

May 21, 2003 (JP) ..... 2003-143551

(51) Int. Cl.
*A44B 19/26* (2006.01)
*A44B 19/30* (2006.01)

(52) U.S. Cl. ..... 24/421; 24/418; 24/424; 24/415

(58) Field of Classification Search ..... 24/415–425
See application file for complete search history.

(56) References Cited

U.S. PATENT DOCUMENTS 2,634,485 A 4/1953 Firing
4,048,699 A 9/1977 Kanzaka
4,102,022 A 7/1978 Aoki
4,271,567 A 6/1981 Aoki
4,980,954 A 1/1991 Takabatake et al.

(Continued)

FOREIGN PATENT DOCUMENTS

GB 2 178 105 2/1987

(Continued)

OTHER PUBLICATIONS

European Search Report, European Application No. 04 25 2970, mailed Sep. 15, 2004.

*Primary Examiner*—Robert J Sandy
(74) *Attorney, Agent, or Firm*—Alston & Bird LLP

(57) ABSTRACT

The invention provides a spring body for a slide fastener and a slider having the spring body mounted thereon, comprising: the spring body made of a platy material having an opening window portion at the opposite side of a pawl portion, and entirely formed in a lateral C-shape; a spring piece having a figuration that a longitudinal center portion of the platy material is cut out outward from a side end portion of a main body of the opening window portion to be pulled up at a required height in many steps, disposed between a rear surface of a pull holding body and a pull with elastic contact, and the pawl portion engaged with or released from a portion of a coupling element row by operating the pull through an inside of the slider body. Consequently, it can get the spring body enabling a material and manufacturing cost reduced, a stable and excellent productivity; a slider with an automatic stop function acquiring and realizing inexpensive structure, miniaturization, and simple assembly.

10 Claims, 10 Drawing Sheets

U.S. PATENT DOCUMENTS

| | | | |
|---|---|---|---|
| 5,884,373 | A | 3/1999 | Kawamura |
| 6,438,806 | B1 | 8/2002 | Lin |
| 6,647,599 | B2 | 11/2003 | Lin |
| 7,089,632 | B2 | 8/2006 | Keyaki et al. |
| 7,207,092 | B2 | 4/2007 | Iwase et al. |

FOREIGN PATENT DOCUMENTS

| | | |
|---|---|---|
| JP | Y-46-35376 | 12/1971 |
| JP | Y-61-27449 | 8/1986 |
| JP | Y-62-490 | 1/1987 |
| JP | A-10-127313 | 5/1998 |

SLIDER FOR SLIDE FASTENER HAVING A SPRING BODY MOUNTED THEREON

CROSS REFERENCE TO RELATED APPLICATIONS

This application is a continuation application of U.S. patent application Ser. No. 10/831,551 entitled "Slider for Slide Fastener and Slider Having a Spring Body Mounted Thereon" and filed on Apr. 23, 2004, now U.S. Pat. No. 7,356,887, which is hereby incorporated by reference in its entirety and which claims priority from Japanese Patent Application Number 2003-143551 filed on May 21, 2003 and which is hereby incorporated by reference in its entirety.

BACKGROUND OF THE INVENTION

1. Field of the Invention

The present invention relates to a spring body for a slide fastener and a slider having the spring body mounted thereon, and particularly, the invention relates to a spring body for a slide fastener and a slider with an automatic stop function having the spring body mounted thereon, whereby the slider is miniaturized, the material cost is reduced, and the exterior design is improved.

2. Description of the Related Art

Conventionally, a slider for a slide fastener provided with an automatic stop function is used in many cases, in which the automatic stop function stops the movement of a slider body in such a manner that, by operating a pull against the slider body for coupling and releasing tooth rows of a fastener chain, a pawl portion of a spring body made of a long and minute elastic metal platy material is engaged with a part of the tooth row of the fastener chain. A structural example of such a slider is disclosed, for example, in Japanese Patent Laid-Open Publication No. 10-127313 proposed by the present applicant in advance. In the slider disclosed in this publication, a front attaching post and a rear attaching post are built back and forth on the slider body, a projection piece portion is protruded on a top surface of the front attaching post, a pawl hole is formed on the front side of the rear attaching post and a pull guide surface is inclined downwardly step by step toward the front side in adjacent to the pawl hole. On the pull guide surface, a pintle of the pull is mounted across the rear attaching post and a spring body is mounted on the pintle of the pull.

In this spring body, a pawl portion made of a long element bends at an end of the elastic metal platy member, a hook portion made of a short element bends at the other end in the same direction as the pawl portion, and a cut-out hole is provided by cutting a center of a spring piece. The hook portion of this spring body is freely fit into the projection element of the front attaching post through the cut-out hole of the spring body to be hooked thereon, and at the same time, the pawl portion of the spring body is engaged between the teeth of the fastener chain through the pawl hole of the slider body. Then, the cover body holding the pull covers the spring body against the elastic force of the spring body to be supported and fixed on the front attaching post and the rear attaching post.

According to the operation by the slider assembled as described above, when a user picks up the pull by hands, the spring body is picked up against the elastic force of the spring piece, and the pawl portion of the spring body is left from the teeth of the fastener chain. In this state, the slider body is freely moved to the front side so as to couple the tooth rows of the fastener chain. Then, leaving the pull, due to the action of the spring piece of the spring body, the pawl portion is automatically inserted between the teeth of the fastener chain so as to stop the movement of the slider. In addition, if the pull is pulled backwardly, the pintle of the pull rises along the pull guide surface of the slider body and this makes the spring body to be pulled up against the elastic force of the spring piece and the pawl portion of the spring body is left from the teeth of the fastener chain. Then, the slider body can freely move backward to leave from the tooth rows of the fastener chain right and left.

In the meantime, upon forming such a kind of spring piece, when a base portion of the spring piece is cut out obliquely upward directly from a longitudinal middle portion of the elastic metal platy material and a horse-shoe shaped cut-out hole is formed, an oscillation range of the spring piece becomes narrow and it lacks flexibility. Therefore, when the entire spring body is oscillated and this spring piece is fit in the cut-out hole of this spring piece and is hooked in the cutout hole, this involves a problem such that the spring piece does not return to the original state and the automatic stop function of the slider is lost.

In order to solve this problem, for example, in Japanese Utility Model Publication No. 46-35376 proposed by the present applicant in advance, an example of the spring body is disclosed, which is incorporated in the slider of the slide fastener provided with the automatic stop function. The spring body disclosed in this publication has a pair of front and rear oblique plane portions bending obliquely downward back and forth of a long and minute elastic metal platy material; a pair of front and rear leg portions bending vertically downward in connection with respective oblique plane portions; a pair of right and left engaging projections that are protruded at the both sides of the front end leg portion; a pawl portion that is protruded at the rear end leg portion; and a trapezoidal spring piece, which is made by cutting out a portion of the platy material upward and its right and left side faces are tapered, at a lateral middle portion of the elastic metal platy material. In this spring piece, its base portion bends downward more than one step toward the front end side at a position higher than the upper surface of an edged line portion at a rising side of the spring piece of the cut-out hole. The entire spring piece is elongated obliquely upward around the base portion, and a required gap is formed on a flat face with the rising side edged line portion.

In this conventional spring body, the base portion of the spring piece bends and rises upward once, the front end portion of the spring piece is elongated obliquely upward at a required gap with the rising side edged line portion of the spring piece of the cut-out hole, so that there is a gap between the right and left side surfaces and the cut-out hole of the spring piece even when the spring body is oscillated and the spring piece is prevented from being fit into the cut-out hole. In addition, the right and left side surfaces at the front end portion of the spring piece have taper trapezoidal outlines and a flat gap is formed between the rising side edged line portion of the spring piece of the cut-out hole and the spring piece after bending processing, so that it is possible to prevent the rising side edged line portion and the spring piece from overlapping with each other on the oscillation of the spring body.

In addition, another example of a spring body having a pawl portion that is engaged with or released from a portion of tooth rows of a fastener chain is disclosed, for example, in Japanese Utility Model Publication No. 61-27449 and Japanese Utility Model Publication No. 62-490 that are proposed by the present applicant in advance. In the spring body disclosed in these publications, a long spring piece having a predetermined cross section is made of one sheet of elastic metal material by a cutting-out processing.

In the meantime, the spring bodies disclosed in the above-described Japanese Patent Laid-Open Publication No. 10-127313 and Japanese Utility Model Publication No. 46-35376 are made of a metal material such a copper alloy and a stainless steel having a spring property as a long member having a predetermined cross section with its spring piece made in a size corresponding to a width and a length of the cut-out hole made of the metal material. However, since the spring body is a small element of several mm, a width and a length cut out along the outer peripheral end edge of the member become smaller. Therefore, for example, when the spring piece is molded from the metal material having a strong spring property, if the very small part such as the spring piece requires a cut-out processing and a bending processing much, this involves a problem such that the spring piece suffers some cracks during processing or abrasion of a blanking punch blade is hastened. In other words, if the excess force is applied to the front end portion of the spring piece, the spring piece is cut and damaged or it suffers some cracks. Accordingly, it is not possible to improve a processing precision of the front end portion of the spring piece to expect the stability of the figuration and further, there is a limitation in manufacturing many products with a high precision.

On the other hand, in order to acquire the spring body having the spring piece by the cut-out processing that is disclosed in the above-described Japanese Utility Model Publication No. 61-27449 and Japanese Utility Model Publication No. 62-490, a cut-out hole formed along the peripheral end edge of the spring piece is needed separately. Therefore, a width of one sheet of the elastic metal material necessary for cutting out the hole should be set at least larger than the size obtained by adding a width of the cut-out hole to the width of the spring piece. In addition, according to such a cut-out processing, it is impossible to mold a spring body without producing broken ends, broken waste or the like by cutting out, and many scraps such as the broken ends or the like due to cutting out upon molding the spring body occur.

Therefore, such a structure uses materials wastefully and this has limitations in downsizing and miniaturization of the entire spring body. Further, in order to dispose the scraps, various facilities are required and this leads to a defect such that a cost of equipment is escalated and an administration cost is also escalated in connection with increase in the cost of equipment. Moreover, if many minute broken ends fly in air, this may provide health problems.

Generally, when the width of the spring body becomes large, the outline measurement of the pull holding body should be made also larger than the size of the spring body, so that this inevitably leads to growing in size of the entire slider. In addition, in connection with growing in size of the entire slider, since the pull holding body and the slider body are naturally made larger, a cost of manufacturing a mold is increased, and further, the used amount of the material or the like are also increased, so that this involves a disadvantage such that the material cost is high and the slider cannot be manufactured at a low cost. Furthermore, there are problems such that the appearance of the slider is deteriorated in accordance with growing in size of the pull holding body and the slider body and its commercial value is lowered.

Thus, the arts disclosed in the above-described Japanese Patent Laid-Open Publication No. 10-127313 and Japanese Utility Model Publication No. 46-35376 have limitations in mass-producing the spring pieces with a high accuracy depending on the size of the spring body, and according to the arts disclosed in Japanese Utility Model Publication No. 61-27449 and Japanese Utility Model Publication No. 62-490, the sizes of the pull holding body and the slider body are inevitably restricted by the size of the spring body. Therefore, simplicity, downsizing and miniaturization in molding the spring body are strongly requested. If this requests are satisfied, it is possible to effectively use the inner spaces of the pull holding body and the slider body having the same measurements as the conventional cases even when assembling the spring body.

The invention has been made taking the foregoing problems into consideration and a first object of the invention is to provide a slider for a slide fastener capable of reducing a material cost and a manufacturing cost, and capable of realizing a stable and excellent productivity, and a second object of the invention is to provide a slider with an automatic stop function, and its structure is simple and inexpensive, which can be miniaturized while securing a stable and excellent automatic stop function, and in which a spring body is mounted, whereby an excellent exterior design can be acquired.

SUMMARY OF THE INVENTION

The invention provides a spring body, which is supported and fixed on an upper portion of a slider body for coupling and releasing tooth rows of a fastener chain, has a spring piece to be elastically disposed between the pull and a rear surface of a pull holding body for holding a pull movably between the pull holding body and an upper surface of the slider body, and has a pawl portion to be engaged with and released from a portion of the tooth rows of the fastener chain through the inside of the slider body on the basis of the elastic deformation of the spring piece by operating the pull, wherein the spring body is made of a platy material having an opening window portion at one end side thereof and having the pawl portion at a front end of the other end side, and the spring piece has a figuration which is cut out and pulled up at a predetermined height in such a manner that a longitudinal center portion of the platy material is cut out outward from the end portion of the opening window portion to be bent.

The spring body according to the invention is manufactured in such a manner that, at first, a region adjacent to the front end surface of the spring piece of the platy material is cut out so as to form a cut-out hole as the opening window portion, then, at the same moment when the right and left side end edges of the spring piece are broken by punching-out, the cut-out processing is applied to the spring piece. After this cut-out processing, the bending processing is applied to the spring piece to be bent more than one step downward and be pulled up at a prescribed height. Then, the entire spring body is finished in an approximately lateral C-shape.

In the meantime, in the spring body according to the invention, it is preferable that, before applying the cut-out processing for the spring piece to be processed by using one sheet of a platy material such as a copper apply or a stainless steel, a region in adjacent to the front end surface of the spring piece and a portion of the pawl portion at the proximal end side of the spring piece are punched out respectively in advance to form punched-out holes having required shapes.

According to the invention, since the spring piece is pulled up via the cut-out hole as the opening window portion as described above, due to the existence of the cut-out hole, the cut-out and pulled-up height of the spring piece can be formed sufficiently higher with respect to the platy material, the spring piece can be simply molded, and a strong spring property can be acquired.

In addition, according to the above-described configuration, it is possible to set the platy material at the bare minimum measurement. Accordingly, not only the spring piece with a required size can be efficiently formed, but also, by reducing loss of the platy material, the material cost can be economized, so that a yield ratio of the product can be improved. Furthermore, without needing special various accessory facilities and peripheral apparatuses, a simple existing processing apparatus can be used to improve a productivity, so that the disposing cost, the manufacturing cost and the like can be reduced.

In the spring body, it is preferable that the lateral both side end surfaces of the spring piece are formed in tapered faces, which are contracted step by step toward to the front end thereof. After the bending processing, a gap is formed between a periphery of the front end portion of the spring piece and the cut-out hole formed by cutting out the spring piece outward. Therefore, even if the spring piece is fit in the cut-out hole when it is elastically deformed, the spring piece is not hooked on the cut-out hole, so that it is possible to elastically return the spring body smoothly and securely to its original state. Accordingly, the automatic stop function of the slider can be stably secured for a long period.

In addition, it is preferable that the spring body further has chamfered portions which are inclined in a direction in which the ridge line portions at the rising sides of the spring piece of the cut-out hole formed by cutting out the spring piece outward are approached with each other.

The chamfered portions are chamfered by forming two grooves from the end portion at the side of the main body in adjacent to the front end surface of the spring piece to the longitudinal center portion of the platy material by punching out the both right and left side end edges along the outline figuration of the spring piece before applying the punch-out processing to the spring piece. Therefore, there is no fear such that the spring piece is fit in the cut-out hole and it is not elastically returned to the original state, alternatively, the surface of the cut-out hole does not contact the ridge line portion at the rising side of the spring piece. Furthermore, since the operational range of the spring piece is enlarged, it is possible to sufficiently secure the space for allowing the elastic deformation of the spring piece.

Further, the both right and left side end edges along the outline figuration of the spring piece are applied with punching out processing before applying the punch-out processing to the spring piece and the both right and left side end edges of the spring piece are broken upon punching-out the spring piece. Therefore, without suffering a deficit or some cracks due to the excess force applied to the front end portion of the spring piece unlike a conventional case, the spring piece can be simply and smoothly molded, and the front end figuration of the spring piece is stabled to be reliably formed. Accordingly, it is possible to finely finish the spring body at a predetermined measurement, and a stable and excellent productivity can be realized with a high accuracy.

Unlike as described above, the invention is not needed to be provided with all of the chamfered portions formed at the ridge line portions at the rising sides of the spring piece of the cut-out hole of the platy material, and the tapered faces formed at the both side end portions of the spring piece as the spring body having the approximately rectangular opening window portion at one end portion of the platy material, which is entirely formed in an approximately lateral C-shaped. Further, it is possible to acquire a spring body having a simple and inexpensive structure, capable of achieving miniaturization while securing a stable and excellent automatic stop function of a slider, and having an excellent external design by any of the chamfered portion and the tapered face or arbitrary combinations thereof in relation to other causes such as the length and the width of the spring body, the figuration and the size of the spring piece, and the like.

The above-described spring body can be efficiently used for various sliders. The typical structure of the slider for a slide fastener among the various sliders may comprise a slider body for coupling and releasing tooth rows of a fastener chain and a pull holding body, which is supported and fixed on an upper portion of the slider body and holds a pull movably between the pull holding body and an upper surface of the slider body, wherein the spring piece of the spring body is elastically disposed between a rear surface of the pull holding body and the pull, and the pawl portion of the spring body is engaged with and released from a portion of the tooth rows of the fastener chain through the inside of the slider body on the basis of the elastic deformation of the spring piece by operating the pull.

The slider according to the invention, as same as the conventional case, is composed of four members, namely, the slider body, the pull, the pull holding body, and the spring body. The slider according to the invention, however, is largely different from the conventional slider in that the spring piece of the spring body is formed, which is cut out and pulled up at a predetermined height in such a manner that a longitudinal center portion of the platy material is cut out outward from the end portion at the main body of the opening window portion. Therefore, it is possible to effectively use the inner spaces of the pull holding body and the slider body, the most versatile spring body can be acquired, the excellent external design corresponding to the outline shape of the slider body can be acquired, and the commercial value of the slider can be sufficiently improved.

It is preferable that the slider has first and second post portions on back and forth on the upper surface of the slider body; the pull holding body is composed of a substantially lateral C-shaped cover body having front and rear wall portions that are formed back and forth of a flat upper wall portion so as to be smoothly curved with a desired curvature; and the inner surfaces at the front end portions of the respective wall portions have engaging pieces to be elastically engaged with locked portions that are formed in the post portions.

The space surrounded by the rear surface of the pull holding body and the upper surface of the upper blade piece becomes an operational space portion for operating the pintle of the pull and the spring body when the engaging piece of the pull holding body and the locked portion of the post portion are engaged with each other. The pull holding body can be formed with the bare minimum of the thickness and the slider can be miniaturized and thinned.

In addition, the pull holding body may have right and left blade pieces that are protruded from right and left of the upper wall portion downward to cover and seal the space portion between the first post portion and the second post portion.

Since the right and left blade pieces of the pull holding body are protruded between the first and second post portions and seal a portion of the space between the both post portions, if the pull is pulled up, the pintle of the pull contacts the right and left blade pieces and the upward moving amount of the pintle of the pull is limited. Therefore, the excess deformation of the spring piece is not produced and the spring piece is not hooked on the cut-out hole, so that the automatic stop function of the slider can be stably secured for a long period by elastically returning the spring piece smoothly and reliably to the original state.

Further, it is preferable that the slider has notch portions at the proximal end portions of the right and left blade pieces and projection portions formed at the post portions are fit in and engaged with the notch portions.

The engaging pieces of the pull holding body are elastically engaged with the locked portions of the slider body, and the notch portions of the pull holding body are fit and engaged with the projection portions of the slider body. Therefore, upon fitting the pull holding body in the upper portion of the slider body, the pull holding body can be solidly and reliably attached to the slider body without oscillation by any forces in the back and forth direction and the width direction, so that the pintle of the pull and the spring body can be reliably held so as to secure the quality of the slider stably for a long period.

Furthermore, it can be configured that the slider has support walls that are built at the right and left end edges of the first and second post portions and at least the front and rear end portions of the pull holding body are fit and supported thereon; and the end portion at the side of the pawl portion of the spring body and the end portion at the opposite side are fit between the right and left support walls.

The pawl portion of the spring body is fit and inserted between the right and left support walls of the second post portion, and the opposite side of the pawl portion is fit and inserted between the right and left support walls of the first post portion with being mounted on the pintle of the pull. The pull holding body is fit and supported between the right and left support walls of the first and second post portions from above the spring body against the elastic force of the spring piece.

According to the above-described configuration, the entire spring body is held between the opposed faces of the right and left support walls of the first and second post portions, and at least the front and rear end portions of the pull holding body are fit and supported therebetween, so that it is possible to elastically deform the spring piece smoothly and reliably in the space formed between the rear surface of the pull holding body and opposed faces of the right and left support walls of the first and second post portions. As a result, a breakage, a defective deformation and a failure of the spring piece can be prevented, and it is possible to secure a ruggedness of the spring body for a long period.

Although the support walls are simply structured to fit and fix the front and rear portions of the pull holding body, upon fitting and fixing them, the spring body is integrally formed so as not to be separated, so that it is possible to remarkably improve the assemble property, the reliability and the like and the slider can be easily treated. Thereby, this assembly can be simply, stably, and reliably carried out by hands as well as by an automatic machine. Further, at least the front and rear end portions of the pull holding body are fit and supported between the opposed faces of the right and left support walls of the first and second post portions, and this pull holding body can be disposed on the same plane as the upper surfaces of the first and second post portions and at the same time, the thickness of the pull holding body can be made thinner. As a result, the light and miniaturized slider can be realized and the slider having the excellent external design and the high commercial value can be acquired effectively.

In addition, it is preferable that the spring body has a hook portion bending at one end thereof, the hook portion is hooked at a projection piece portion that is formed between the right and left support walls of the first post portion, and the end portion at the side of the pawl portion of the spring body is lower than the side of the hook portion and is entirely inclined.

According to the above-described configuration, the hook portion of the spring body can be reliably positioned and the oscillation of the spring body can be smoothly carried out on the basis of the hook portion to act by the operation of the pull. It is also possible to acquire the operational space between the rear surface of the pull holding body and the first and second post portions of the slider body, which is sufficiently spacious for allowing the operation of the pintle of the pull and the spring body.

In addition, it is preferable that the slider has first and second post portions at the front and rear end portions on the upper surface of the slider body, the pull holding body is composed of a rectangular box having a ceiling wall portion, front and rear side wall portions, and right and left side wall portions on which a notch is formed at its center portion; the pull holding body is externally fit to the first and second post portions of the slider body; and the pull holding body seals the upper portion of the slider body to be secured on the upper portion.

According to such a configuration, the space surrounded by the rear surface of the pull holding body and the first and second post portions of the slider body becomes an operational space portion for operating the pintle of the pull and the spring body. Thus, according to the invention, by cutting out the longitudinal center portion of the platy material outward from the end portion at the side of the main body of the opening window portion, it is possible to effectively use the most versatile spring body having the spring piece that is bent more than one step and is cut out and pulled up at a predetermined height in various sliders.

It is preferable that the slider has a projection piece portion at the upper portion of the first post portion, the projection piece portion is freely fit in the opening window portion of the spring body to be hooked thereon, and the other end portion at the side of the pawl portion of the spring body is lower than the side of the opening window portion and is entirely inclined.

According to this configuration, since the entire spring body is held and assembled on the slider body with inclined downward toward the other end portion at the side of the pawl portion from the opening window portion, it is possible to acquire an operational space portion, which is sufficiently spacious for allowing the operation of the pintle of the pull and the spring body between the rear surface of the pull holding body and the first and second post portions of the slider body.

Operating the pull, in connection with the operation of the pull, the spring piece of the spring body is oscillated around the hook portion of the spring body that is freely fit and hooked on the projection piece portion that is protruded on the upper portion of the first post portion while elastically deforming the pawl portion of the spring body in a direction to be engaged with or be released from the coupling element. When the spring body is oscillated to the movement limitation position, the pawl portion is engaged with or released from the coupling element. Thus, by the operation of the pull, it is possible to elastically deform the spring piece smoothly and easily, and a breakage, a defective deformation and a failure of the spring piece can be prevented, so that it is possible to improve a ruggedness of the spring body.

DESCRIPTION OF THE PREFERRED EMBODIMENTS

Preferred embodiments of the invention will be specifically described below with reference to the drawings.

Figure 1:
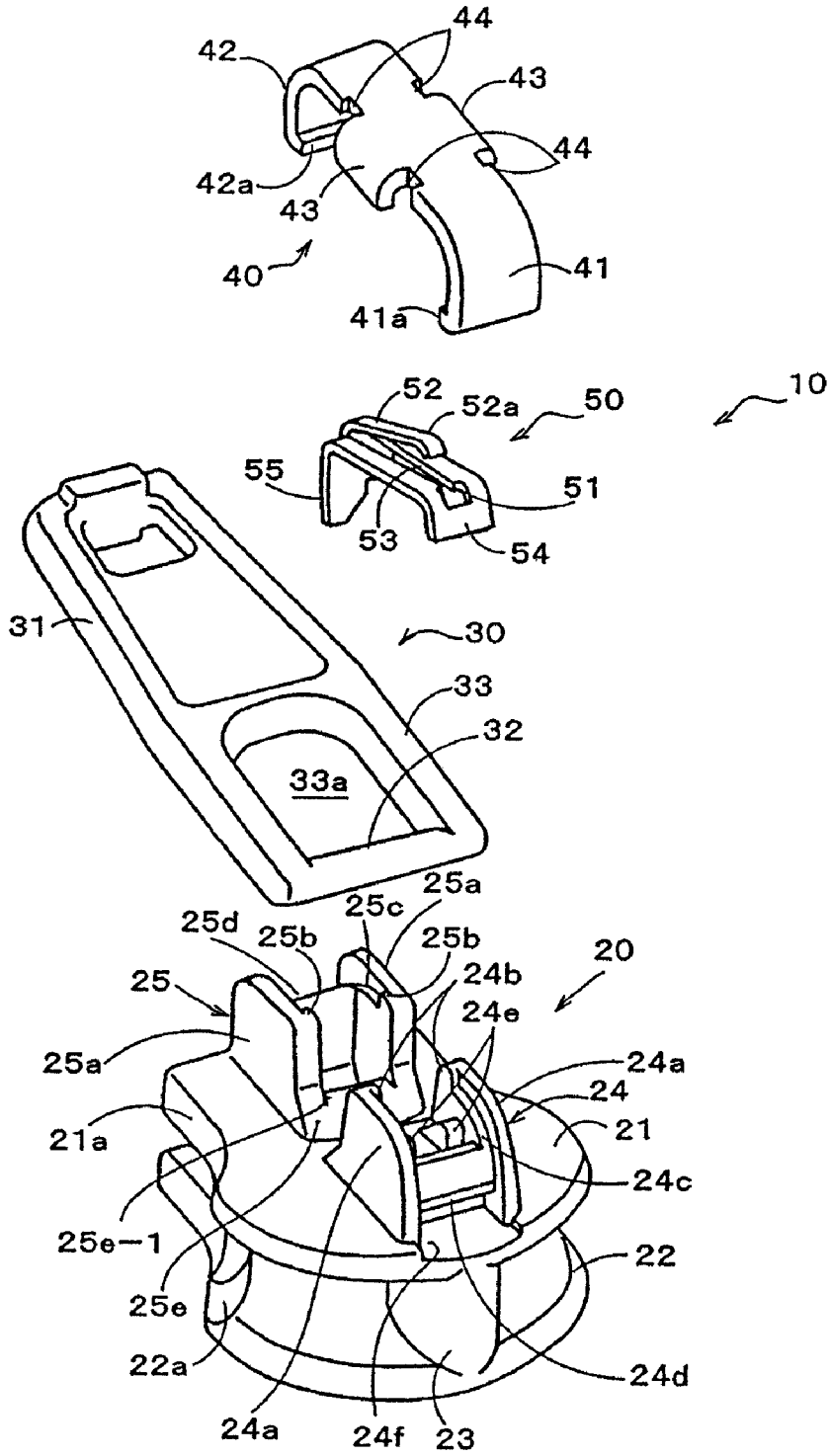
FIG. 1 is a perspective view showing a state in which parts composing a slider for a slide fastener having an automatic stop device as a typical first embodiment according to the invention are separated.
Figure 2:
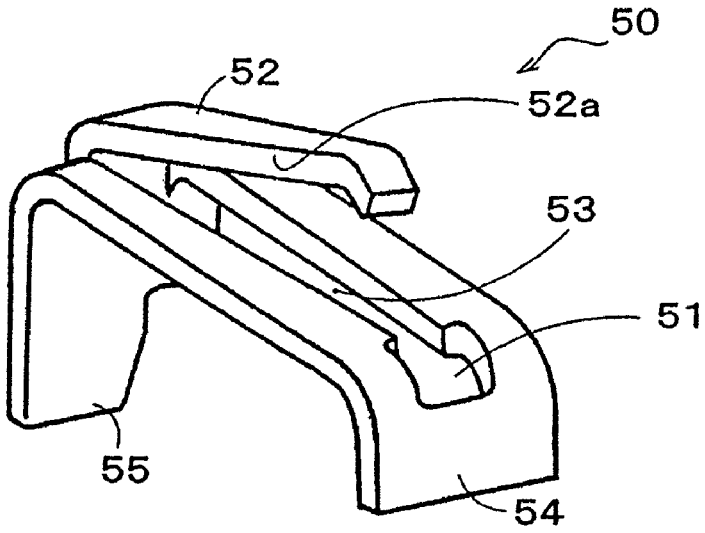
FIG. 2 is a perspective view showing a spring body composing a portion of the slider.
Figure 3:
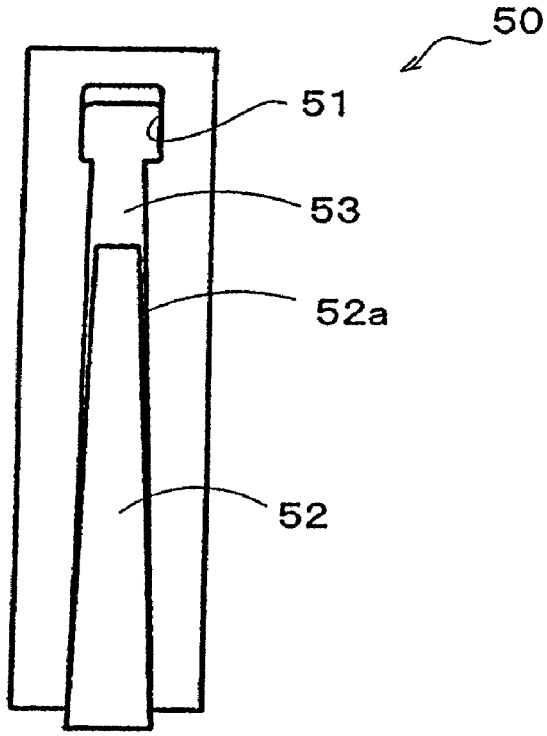
FIG. 3 is a plane view of the spring body.
Figure 4:
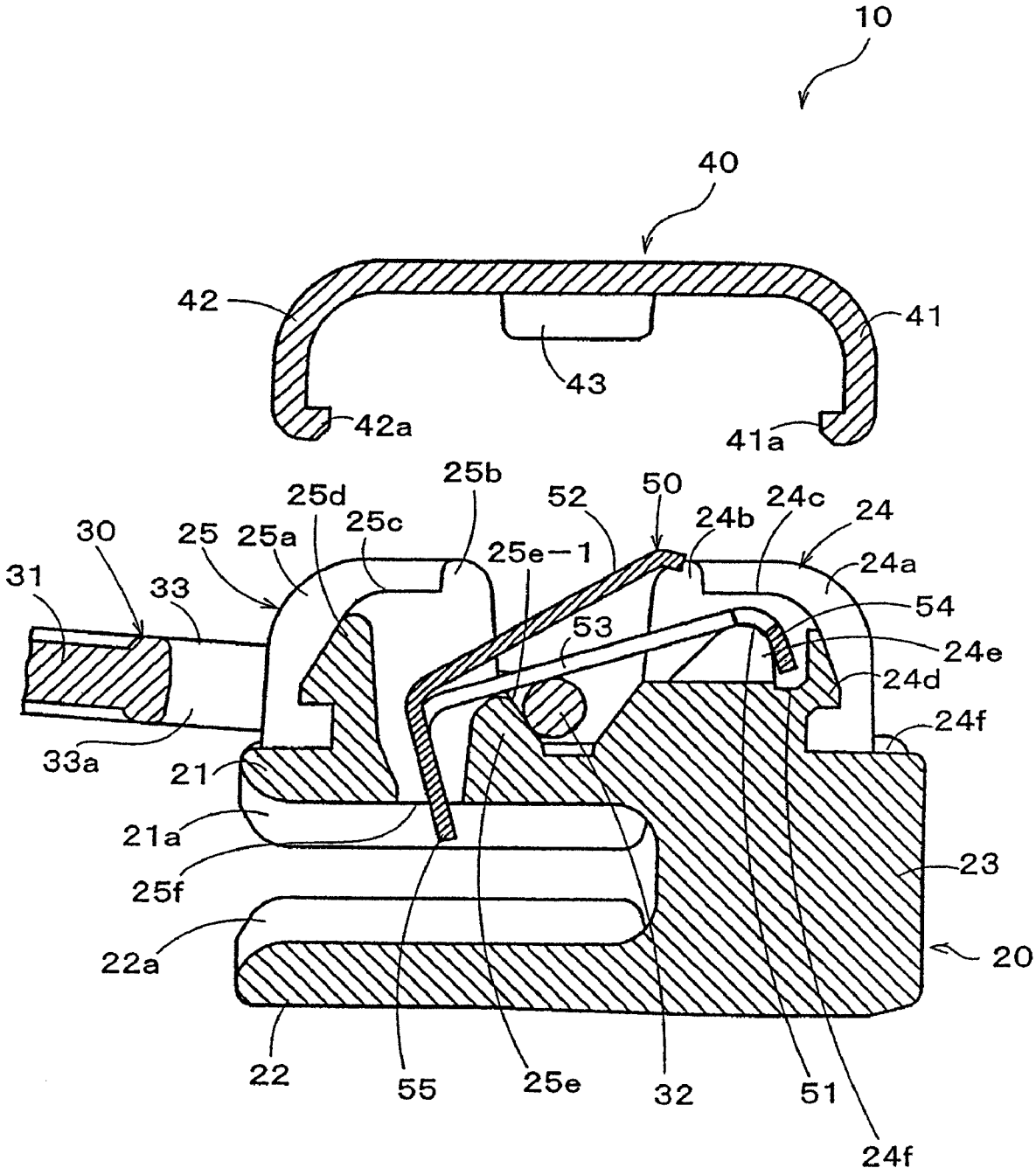
FIG. 4 is a major part longitudinal sectional view showing an assembling order of the slider.
Figure 5:
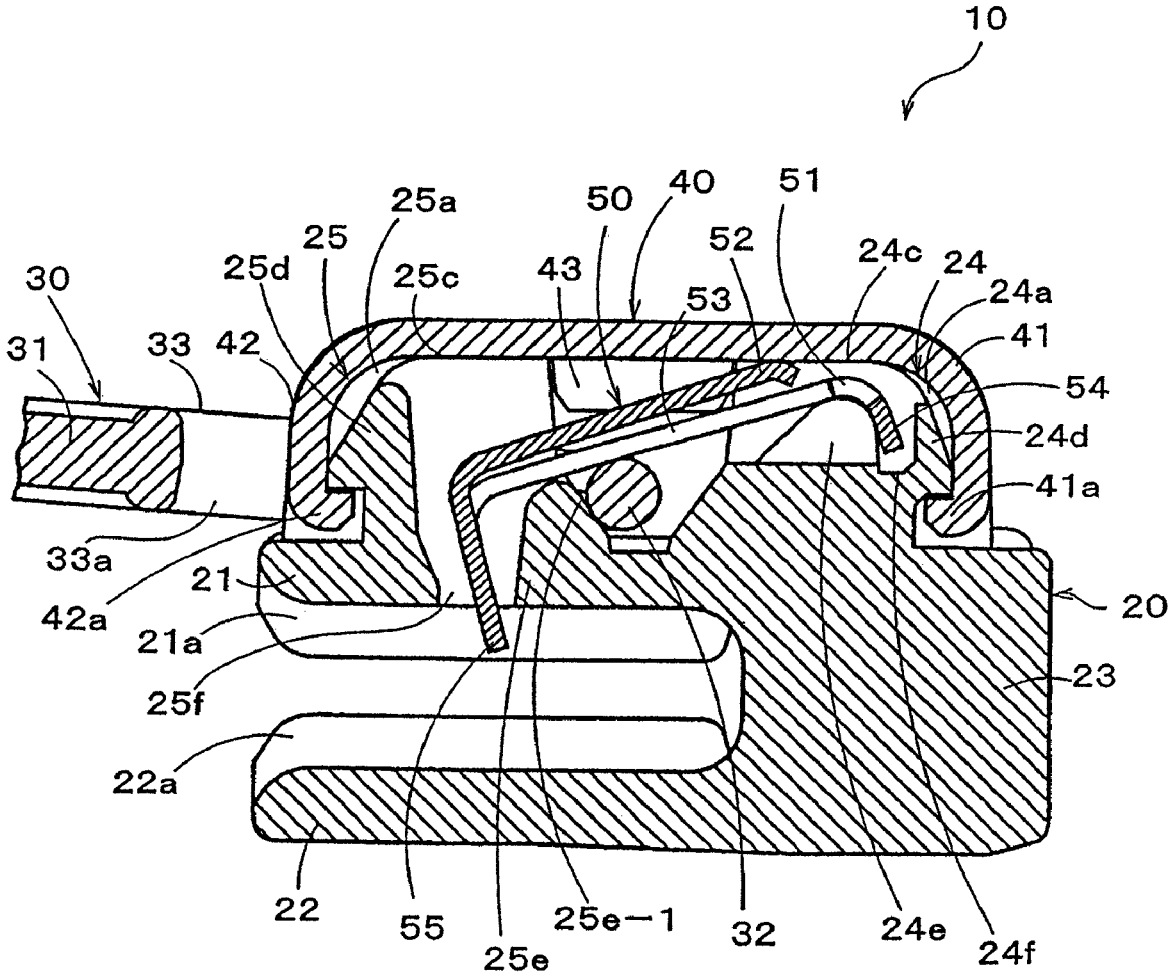
FIG. 5 is a major part longitudinal sectional view showing an inner structural example after assembling the slider.
Figure 6:
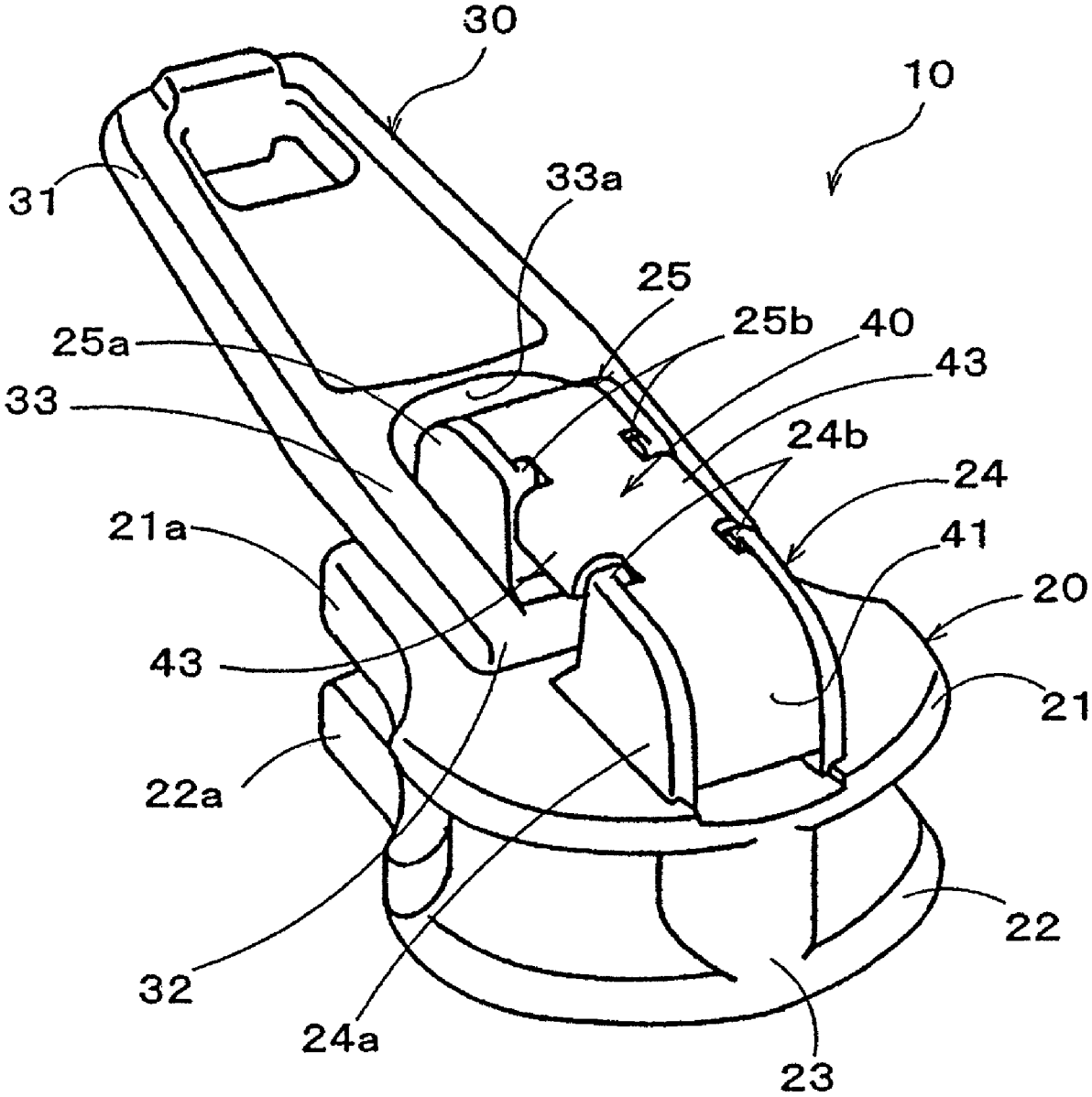
FIG. 6 is a perspective view of the slider.
Figure 7:
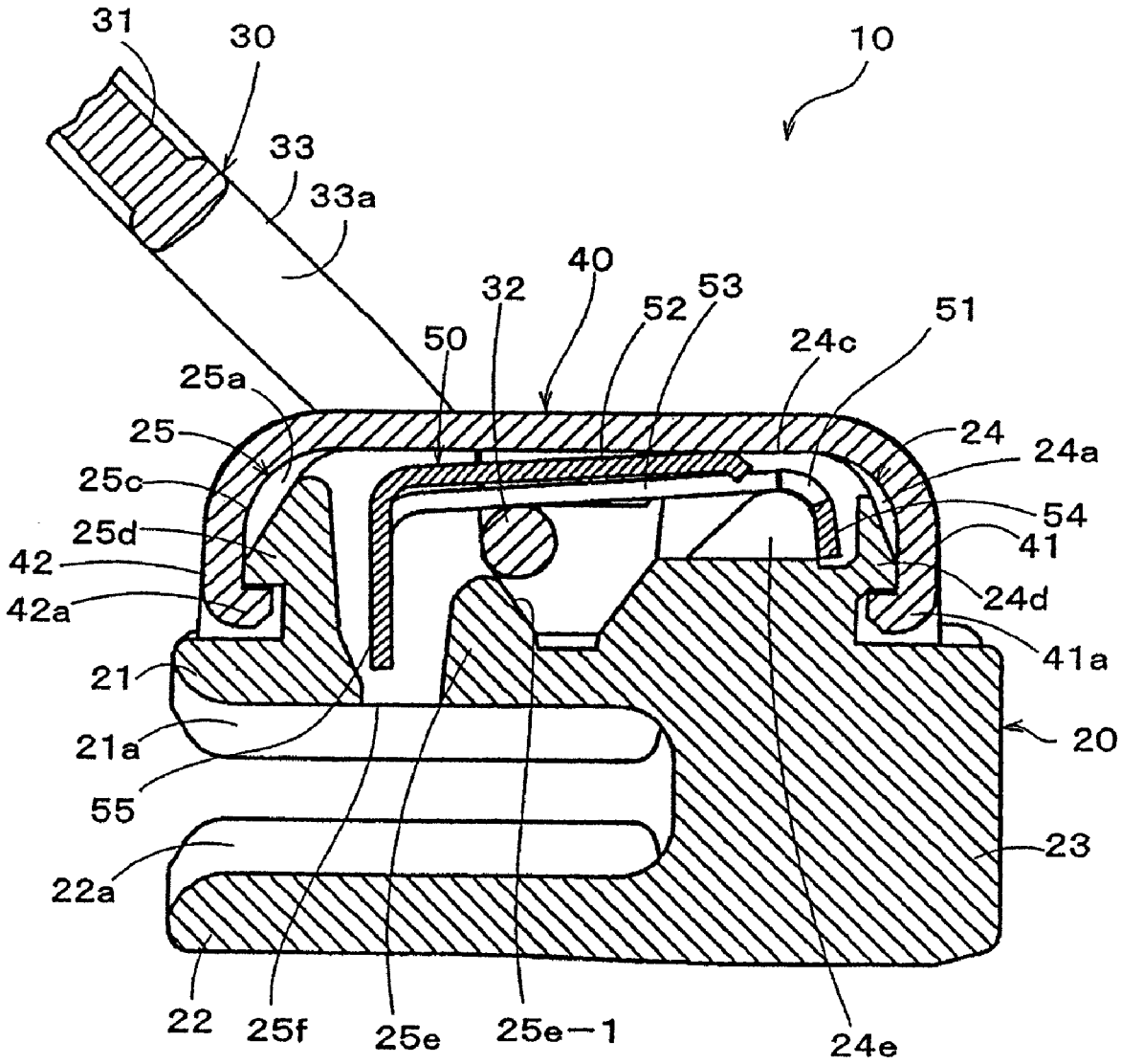
FIG. 7 is an explanatory view showing a state in which locking of the spring body of the slider is released.

FIGS. 1 to 7 illustrate a typical first embodiment according to the invention. FIG. 1 is a perspective view showing a state in which parts composing a slider for a slide fastener having an automatic stop function are separated; FIG. 2 is a perspective view showing a spring body composing a portion of the slider; FIG. 3 is a plane view of the spring body; FIG. 4 is a major part longitudinal sectional view showing an assembling order of the slider; FIG. 5 is a major part longitudinal sectional view showing an inner structural example after assembling the slider; FIG. 6 is a perspective view of the slider; and FIG. 7 is an explanatory view showing a state in which locking of the spring body of the slider is released. In the meantime, according to the invention, a shoulder opening side of the slider is referred to as a forward portion and a rear opening side of the slider is referred to as a rear portion.

A slider 10 for a slider fastener having an automatic stop device of the invention shown in FIG. 1 is composed of four members, namely, a slider body 20, a pull 30, a pull holding body 40, and a spring body 50. The slider body 20 and the pull 30 are manufactured by die cast molding by using a metal material such as an aluminum base alloy and a zinc alloy. The pull holding body 40 and the spring body 50 are manufactured by a press working by using a long minute elastic metal platy material such as a copper alloy and a stainless steel. In the meantime, three members including the slider body 20, the pull 30, and the pull holding body 40 are made of a thermoplastic resin such as polyamide, polypropylene, or polyacetal, polybutylene terephthalate, and a thermoplastic resin material having an abrasion resistance reinforcement added thereto, respectively, in place of the metal material, and they are manufactured by an injection molding.

The slider body 20 has an upper blade piece 21, a lower blade piece 22, and a connecting post 23 for connecting the front end portions of these upper and lower blade pieces 21 and 22. The upper and lower blade pieces 21 and 22 have right and left upper and lower flanges 21*a* and 22*a*, respectively, from their rear ends to approximately center positions thereof, and a Y-shaped coupling element guide passage is formed between the upper and lower blade pieces 21 and 22.

On the back and forth on the upper surface of the upper blade piece 21 of the slider body 20, front and rear fitting posts 24 and 25 as first and second post portions for attaching the pull holding body 40 thereto as a narrow platy cover body are integrally formed on the upper surface of the upper blade piece 21 to rise thereon. There are predetermined intervals between these front and rear fitting posts 24 and 25 so as to form a space sufficient to house a portion of the pull 30, the spring body 50, and the pull holding body 40.

The rear fitting post 25 at the side of the rear opening of the slider (the left side in FIG. 4) is configured by a pair of right and left rear support walls 25*a*, 25*a* which are separated at an interval corresponding to the outline of the pull holding body 40. On the opposed faces of these rear support walls 25*a*, a stepped portion 25*c* is formed having a step falling from the upper end edge by a predetermined height with a projection portion 25*b* left at a front end corner portion. The stepped plane of this stepped portion 25*c* is formed as a contact surface of the pull holding body 40 for preventing the pull holding body 40 from being further fit when the pull holding body 40 is fit between the rear support walls 25*a*, 25*a*. On the top surface of the projection portion 25*b* is disposed with the same height as that of the upper surface of the pull holding body 40 upon fitting the pull holding body 40.

On the opposed faces close to the rear portions of these support walls 25*a*, a liner locked portion 25*d* is integrally formed to be elongated across the both right and left side surfaces. This locked portion 25*d* is shaped in a step having a guide inclined plane smoothly falling along the stepped plane of the right and left stepped portions 25*c* and an edge portion engagement surface to be engaged with and disengaged from the pull holding body 40. On the front opposed faces of this support wall 25*a*, a liner pull guide portion 25*e* elongated across its right and left side surfaces are formed at a position lower than the locked portion 25*d*.

On the front end surface of this pull guide portion 25*e*, a pull guide surface 25*e*-1 for guiding a pintle 32 of the pull 30 is formed by a tapered face that is inclined downward step by step along the front end surface of the support wall 25*a*. The pull guide surface 25*e*-1 leads and guides the pull 30 toward a moving limitation position of the spring body 50 from the front proximal end of the pull guiding portion 25*e* upon operation of the pull 30. Between the front proximal end of the locked portion 25*d* and the rear proximal end of the pull guide portion 25*e*, a rectangular pawl hole portion 25*f*, in/from which a pawl portion 55 of the spring body 50 is inserted/detached, is cut through upward and downward of the upper blade piece 21 so that the pawl hole portion 25*f* is communicated with a coupling element guide passage.

The front fitting post 24 at the side of the shoulder opening of the slider (the right side in FIG. 4) is configured by a pair of right and left front support walls 24*a*, 24*a* which are set at the same width measurement as the rear fitting post 25. On the opposed faces of these front support walls 24*a*, as same as the rear fitting post 25, a stepped portion 24*c* is formed having a step falling from the upper end edge by a predetermined height with a projection portion 24*b* left at a rear end corner portion. The stepped plane of this stepped portion 24*c* is formed as a contact surface of the pull holding body 40, and on the front opposed faces of the support wall 24*a*, a liner locked portion 24*d* elongated across the both right and left side surfaces is integrally formed.

This locked portion 24*d* is shaped in a step having a guide inclined plane smoothly falling along the stepped plane of the right and left stepped portion 24*c* and an edge portion engagement surface to be engaged with and disengaged from the pull holding body 40. At a center of the front opposed faces of this support walls 24*a* and on the upper surface of the upper blade piece 21, a pair of right and left platy projection piece portions

24*e* having a cross section curved in a moderate arc upward are protruded, and the upper surfaces of the projection piece portions 24*e* are formed as faces on which the spring body 50 is mounted. Between the opposed faces of the support walls 24*a* and at a center in a width direction of the upper surface of the upper blade piece 21, a concave groove portion 24*f* is formed between the projection piece portions 24*e* and the locked portion 25*d*.

As shown in FIG. 1, the pull 30 is configured by a strip-shaped platy material. The pull 30 has a handle portion 31 at one end side thereof and a circular holding portion 33 having an approximately square hole 33*a*, in which the rear fitting post 25 can be fit, at the other end side thereof. A front end portion of this circular holding portion 33 is formed like a bridge as the pintle 32 having a circular cross section. The length of this pintle 32 is set larger than the width measurement of the rear fitting post 25 and upon mounting the pull, the pintle 32 is guided and inserted in the pull guide portion 25*e* across the rear fitting post 25.

The pull holding body 40, as shown in FIG. 1, is configured by a thin long platy material, namely, by a substantially lateral C-shaped cover body having front and rear wall portions 41 and 42 that are smoothly curved with the same curvature back and forth of the flat upper wall portion. On the inner surfaces at the front end portions of these wall portions 41 and 42, engaging pieces 41*a* and 42*a* are protruded, respectively, which are elastically engaged with and disengaged from the edge portion engaged surfaces of the locked portions 24*d* and 25*d* of the respective fitting posts 24 and 25. On the right and left of the upper wall portion of the pull holding body 40, wide right and left blade pieces 43, 43 are protruded to seal and cover a portion of the space between the front fitting post 24 and the rear fitting post 25, and their upper surfaces are curved downward having a projection curved surface with the same curvature. On a ridge line (a corner portion) of these right and left blade pieces 43 and the upper wall portion, notch portions 44 to be fit and engaged with the pair of projection portions 24*b* and 25*b* of the front fitting post 24 and the rear fitting post 25 are formed, respectively. The notch portions 44 are formed with steps that are recessed from the both linear side end surfaces of the right and left blade pieces 43 inwardly.

These right and left blade pieces 43 are formed at the substantially same length as the length between the front fitting post 24 and the rear fitting post 25, and they are formed shorter than the lengths of the wall portions 41 and 42. Accordingly, under the state in which the slider body 20 and the pull holding body 40 are engaged with each other, the lower end surfaces of these right and left blade pieces 43 are separated from the upper surface of the upper blade piece 21 so as to form a space portion for allowing the operation of the pintle 32 of the pull 30. The space surrounded by the rear surface of the pull holding body 40 and the upper surface of the upper blade piece 21 becomes an operational space portion for operating the pintle 32 of the pull 30 and the spring body 50 when the slider body 20 and the pull holding body 40 are engaged with each other.

According to the above-described configuration, the pull holding body 40 is fit and supported between the opposed faces of the support walls 24*a* and 25*a* of the front and rear fitting posts 24 and 25, and this pull holding body 40 can be disposed on the same plane as the upper surfaces of the support walls 24*a* and 25*a*. Therefore, the pull holding body 40 can be formed with the bare minimum of the thickness and the slider 10 can be miniaturized and thinned, so that it is possible to acquire a slider having an excellent exterior design and a high commercial value. In addition, the engaging pieces 41*a* and 42*a* of the pull holding body 40 are elastically engaged with the locked portions 24*d* and 25*d* of the front and rear fitting posts 24 and 25 and the notch portions 44 of the pull holding body 40 are fit and engaged with the pair of projection portions 24*b* and 25*b* of the front fitting post 24 and rear fitting post 25. As a result, the pull holding body 40 can be solidly and reliably attached to the slider body without oscillation by any forces in the back and forth direction and the width direction, so that a spring piece 52 of the spring body 50 can be smoothly and reliably held so as to secure the quality of the slider 10 stably for a long period.

A main characteristic part of the invention is a structure of the spring body 50. The spring body 50 as the most typical structural example of the invention has a main body made of a platy material such as a copper alloy or a stainless steel, and a rectangular opening window portion 51 at a longitudinal one end side of the main body, and the spring body 50, which has a pawl portion 55 at the front end of the longitudinal other end side of the main body, is entirely formed in a substantially lateral C-shape. On this spring body 50, a flat spring piece 52 is formed, which is cut out, bent and pulled up at a predetermined height in such a manner that a longitudinal center portion of the platy material is cut out outward from the end portion at the main body of the opening window portion 51.

In order to cut out outward the spring piece 52, the platy material can be set at the bare minimum measurement and further, the amount of the use of the platy material used can be economized, so that a yield ratio of the product can be improved. Furthermore, without needing special various accessory facilities and peripheral apparatuses, a simple existing processing apparatus can be used to improve a productivity, so that the disposing cost, the manufacturing cost and the like can be reduced.

As shown in FIGS. 2 and 3, the both side end portions of the spring piece 52 are formed by tapered faces 52*a*, which are contracted step by step toward to the front end in a shoulder opening direction of the slider, and on the spring body 50, a cut-out hole 53 corresponding to the outline figuration made by cutting out the spring piece 52 outward is continuously formed at the end portion at the side of the main body of the opening window portion 51 with a step toward the lateral outside of the main body across a longitudinal center portion of the platy material.

At the front and rear end portions of the spring body 50, a short platy element and a long platy element are bent downward with respect to the opposed side of the spring piece 52, respectively to be integrally formed in parallel with each other. This short platy element is formed as a hook portion 54 to be mounted on a pair of right and left projection elements 24*e*, 24*e* of the front fitting post 24. This hook portion 54 includes a portion of the opening window portion 51 and the hook portion 54 is set at required measurement and figuration capable of being mounted between the pair of projection elements 24*e*. The front end of one long platy element is formed as the pawl portion 55 for stopping the movement of the slider body 20 against a coupling element of a slide fastener (not shown).

The one side portion at the front end of this pawl portion 55 is formed narrower than the width of the main body of the spring body 50, and through the pawl hole portion 25*f* formed on the upper surface of the upper blade piece 21 in adjacent to the front proximal end of the locked portion 25*d* of the rear fitting post 25, the one side portion at the front end of this pawl portion 55 is formed in required size and figuration capable of being inserted and detached in and from the coupling element guide passage. The proximal end portion of the spring piece 52 throws out with a predetermined height from the cut-out hole 53 in an elbowed shape from the upper end of the pawl portion 55 forward.

In the meantime, although according to the present embodiment, the entireness of the spring piece 52 throws out in an approximately elbowed shape forward, the invention is not limited to this. For example, it is a matter of course that the spring piece 52 may be cut out outward at a predetermined height by applying a bending processing to the spring piece 52 to bend it downward more than one step.

The front end of this spring piece 52 is bent and formed downward as capable of elastically contacting the rear surface of the pull holding body 40, and a flat gap is formed between the front end portion of the spring piece 52 and the ridge line at the rising side of the spring piece 52 of the cut-out hole 53. Even if the spring piece 52 is fit in the cut-out hole 53 when it is elastically deformed, the spring piece 52 is not hooked on the cut-out hole 53, so that the automatic stop function of the slider 10 can be stably secured for a long period by elastically returning the spring piece 52 smoothly and reliably to the original state.

Upon manufacturing the spring body 50, at first, before applying the cut out and pulling-out processing to the spring piece 52 to be machined, a region adjacent to the front end surface of the spring piece 52 of the platy material is cut out in advance so as to form a cut-out hole as the opening window portion 51 and at the same time, a portion of a part where the pawl portion 55 of the platy material is formed is cut out to be broken away in advance. Next, at the same moment when the right and left side end edges along the outline figuration are broken by punching-out, which is contracted step by step from the side end portion of the main body of the cut-out hole in adjacent to the front end surface of the spring piece 52 to the longitudinal center portion of the platy material toward the front end of the spring piece 52, the cut-out processing is applied to the spring piece 52 through the opening window portion 51. After this cut-out processing, the bending processing is applied to the spring piece 52, so that the entire spring body having the opening window portion 51 that is pulled up at a predetermined height in an elbowed shape is finished in a substantially lateral C-shape.

Thus, due to the existence of the opening window portion 51, the spring piece 52 can be pulled up through the opening window portion 51, so that a required pulled-up height of the spring piece 52 against the platy material is obtained, and without suffering a deficit or some cracks due to the excess force applied to the front end portion of the spring piece 52 during processing, it is possible to simply and reliably form the spring body 50 with a desired spring property.

In order to assemble the slider 10 configured as described above, as shown in FIG. 4, at first, the circular holding portion 33 of the pull 30 is inserted across the rear fitting post 25 of the slider body 20 and the entire pull 30 is mounted approximately horizontally with the pintle 32 of the pull 30 contacting the pull guide surface of the pull guide portion 25*e* of the rear support wall 25*a*. Next, the spring body 50 is mounted from above the pintle 32 of the pull 30. In this time, the pawl portion 55 of the spring body 50 is fit and inserted in the pawl hole portion 25*f* of the rear fitting post 25, and the hook portion 54 at the opposed side of the pawl portion 55 is hooked on the projection element 24*e* of the fitting post 24 that is located higher than the pawl hole portion 25*f* as being mounted on the pintle 32 of the pull 30. The spring body 50 is disposed on the upper surface of the upper blade piece 21 with being inclined upward from the pawl hole portion 25*f* toward the side of the projection element 24*e*, and the front end portion of this spring piece 52 is disposed between the opposed faces of the support walls 24*a* and 25*a* of the front and rear fitting posts 24 and 25. Next, the pull holding body 40 is fit inside the front and rear fitting posts 24 and 25 from above the spring body 50.

Fitting the pull holding body 40 inside the front and rear fitting posts 24 and 25, in connection with fitting of the pull holding body 40, the engaging pieces 41*a* and 42*a* of the pull holding body 40 slide on the guide inclined planes of the locked portions 24*d* and 25*d* of the front and rear fitting posts 24 and 25 against the elastic force of the spring piece 52 while being elastically deformed in an enlarged and opening direction, and these engaging pieces 41*a* and 42*a* pass the front end inclined planes of the guide inclined planes. At the same time, elastically restoring the engaging pieces 41*a* and 42*a* in a contracted direction, as shown in FIG. 5, the engaging pieces 41*a* and 42*a* are engaged with the edge portion engaged surfaces of the locked portions 24*d* and 25*d*.

Then, at a fitting limitation position of the pull holding body 40, the notch portions 44 of the pull holding body 40 are fit and engaged with the respective projection portions 24*b* and 25*b* of the front and rear fitting posts 24 and 25 as shown in FIG. 6, and the upper surface of the pull holding body 40 is covered with completely housed inside the front and rear fitting posts 24 and 25 and the lower surfaces of the right and left blade pieces 43, 43 of the pull holding body 40 seal a portion of the pull 30 and a portion of the operational space for operating the spring body 50 with being separated from the upper surface of the upper blade piece 21. Thus, the assembly of the slider 10 is completed.

When the slider body 20 and the pull holding body 40 are engaged with each other in a simple structure such that the engaging pieces 41*a* and 42*a* of the pull holding body 40 and the locked portions 24*d* and 25*d* of the front and rear fitting posts 24 and 25 are fit and secured with each other, the spring body 50 is integrally formed so as not to be separated therefrom and this assembly can be simply, stably, and reliably carried out by hands or by an automatic machine. Further, the spring piece 52 can be elastically deformed smoothly and reliably in the space that is formed between the rear surface of the pull holding body 40 and the opposed faces of the front and rear fitting posts 24 and 25, a breakage, a defective deformation and a failure of the spring piece 52 can be prevented, so that it is possible to secure a ruggedness of the spring body 50 for a long period.

FIG. 7 illustrates the operation for releasing the locking of the pawl portion 55 of the spring body 50 from the state shown in FIG. 5. Upon releasing engagement of the pawl portion 55 of the spring body 50 with the coupling element (not shown), at first, as shown in FIG. 5, if the pull 30 that is assembled in parallel with the slider body 20 is pulled up by hands, the pintle 32 of the pull 30 rises along the pull guide surface 25*e*-1 of the pull guide portion 25*e*. In connection with rising of the pull 30, the spring piece 52 of the spring body 50 is slid forward around the pintle 32 of the pull 30 while elastically deforming the pawl portion 55 of the spring body 50 in a direction releasing the engagement of the pawl portion 55 with the coupling element (not shown). When the pintle 32 of the pull 30 moves to the movement limitation position of the spring body 50, the pawl portion 55 is separated from the coupling element via the pawl hole portion 25*f* of the upper blade piece 21 as shown in FIG. 7 so that the engagement of the pawl portion 55 and the coupling element is released.

Upon releasing the engagement, the slider 10 can freely move to the shoulder opening side of the slider (the right side in FIG. 7) or to the rear opening side (the left side in FIG. 7). By freely moving the slider 10, the tooth rows of the fastener chain (not shown) can be coupled with each other and they can be separated horizontally. After this desired operation, if the pull 30 is released, the deformation against the elastic force of the spring piece 52 of the spring body 50 is elastically returned to the original state since the pintle 32 of the pull 30 falls down along the pull guide surface 25*e*-1 of the pull guide portion 25*e*, and the pawl portion 55 of the spring body 50 is automatically inserted between the teeth of the fastener chain via the pawl hole portion 25*f* of the upper blade piece 21. The pawl portion 55 of the spring body 50 and the coupling element are engaged with each other, and in this engagement state, the slider 10 is prevented from further moving, and the slider 10 is maintained in a stop state.

Figure 8:
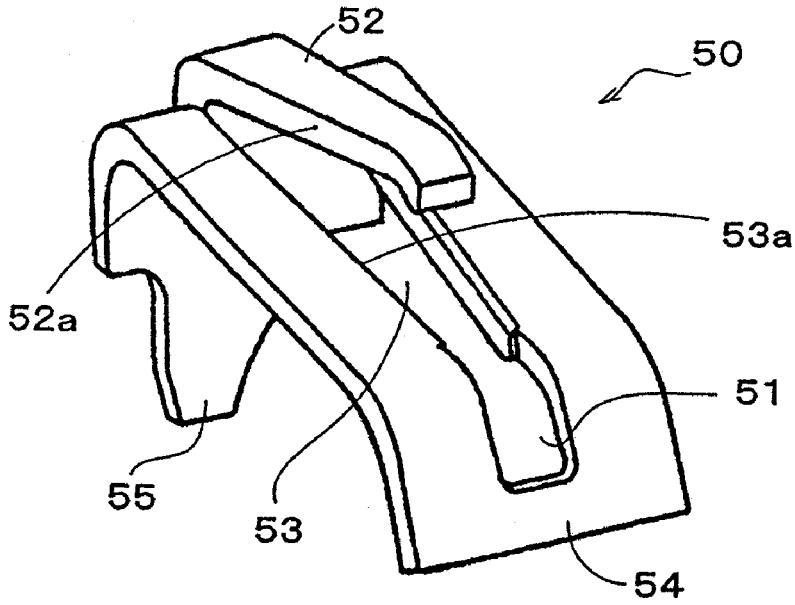
FIG. 8 is a perspective view showing a modified embodiment of the spring body.
Figure 9:
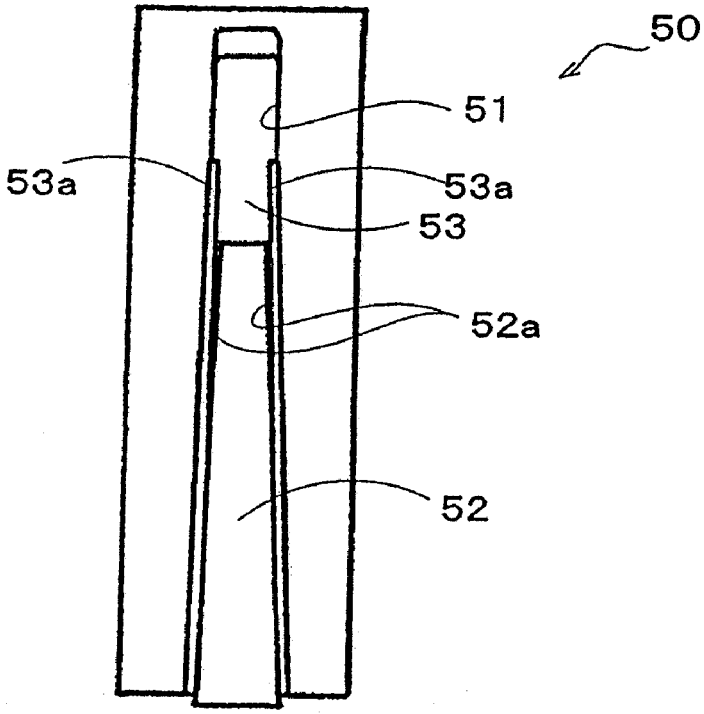
FIG. 9 is a plane view of the spring body.

FIGS. 8 and 9 illustrate a modified example of the spring body 50 according to the invention. FIG. 8 is a perspective view showing the spring body and FIG. 9 is a plane view of the spring body. In these drawings, the modified embodiment is largely different from the first embodiment in that the opening window portion 51 formed at one end portion of the spring body 50 is set longer across the longitudinal center portion of the platy material from the end portion of the rear opening of the slider; that the flat spring piece 52 is cut out and pulled up in a required height in an elbowed shape; and that the ridge line portions at the rising sides of the spring piece 52 have chamfered portions 53*a*. Accordingly, in these drawings, the members that are substantially identical with the first embodiment are given the identical member names and reference numerals.

The opening window portion 51 of the spring body 50 illustrated in the drawings is formed in a rectangular shape longer in a longitudinal direction of the platy material with a step disposed from the front end surface of the cut-out hole 53 corresponding to the outline figuration of the spring piece 52 outward. At the ridge line portions at the rising sides of the spring piece 52 of the cut-out hole 53, the chamfered portions 53*a* are formed, which are inclined downward to the inside. Due to the existence of the chamfered portions 53*a*, a problem such that the spring piece 52 is fit in the cut-out hole 53 when it is elastically deformed and it is not returned elastically to the original state; and the face of the spring piece 52 contacts the ridge line portions at the rising sides of the spring piece 52 of the cut-out hole 53 is solved, so that the space for allowing the elastic deformation of the spring piece 52 is sufficiently secured.

At the front end of the spring body 50, a short platy element that is smoothly bent and formed downward at the opposed side of the spring piece 52 is formed as the hook portion 54 to be hooked on the projection elements 24*e* of the front fitting post 24. On the other hand, at the rear end portion of the spring body 50, a long platy element that is bent and formed at a sharper angle than the short platy element is formed as the pawl portion 55 for stopping the movement of the slider body 20 against the coupling element (not shown). The both sides of the front end of the pawl portion 55 are formed to be gradually narrower than the width of the main body of the spring body 50.

The spring body 50 according to the modified embodiment shown in FIGS. 8 and 9 is identical with the spring body 50 shown in FIGS. 2 and 3 in the following point: before applying the cut-out processing of the spring piece 52 to be processed, a region in adjacent to the front end surface of the spring piece 52 in the platy material is punched out in advance to form a punched-out hole as the opening window portion 51 and a portion of the place where the pawl portion 55 of the platy material is cut out in advance to be broken. However, the method of manufacturing the spring body 50 according to this modified embodiment is largely different from that shown in FIGS. 2 and 3 in that, chamfering is carried out to the both right and left side edges of the spring piece 52 when two grooves are formed by applying the punch processing to the platy material at the both right and left side edges along the outline figuration that is contracted gradually toward the front end of the spring piece 52 to form the chamfered portions 53*a* of the cut-out hole 53.

After chamfering is applied to the both right and left side edges of the spring piece 52, as same as the method of manufacturing the spring body 50 shown in FIGS. 2 and 3, at the moment when the both right and left side edges of the spring piece 52 are broken by the cut-out punch, the punch-out processing is applied. By applying the bending processing after this punch-out processing, the entire spring body having the opening window portion 51 that is cut out and pulled up in an elbowed shape at a predetermined height is finished into a substantially lateral C-shaped figuration.

Thus, before applying the punch-out processing to the spring piece 52, chamfering is carried out when two grooves are formed by applying the punch processing to the both right and left side edges of the spring piece 52, and then, the both right and left side end edges of the spring piece 52 are broken upon punching out, so that the punching out can be simply and accurately positioned, the spring piece 52 can be simply and smoothly molded, and the front end figuration of the spring piece 52 is stabled. Accordingly, it is possible to finely finish the spring body 50 at a predetermined measurement. In addition, according to the modified embodiment of the spring body 50 shown in FIGS. 8 and 9, it is a matter of course that the above-described operational effects can be evidently acquired by the manufacturing method that is substantially identical with that for the spring body 50 shown in FIGS. 2 and 3. However, due to the existence of the opening window portion 51 that is longer than the spring body 50 shown in FIGS. 2 and 3, the cut-out and pulled-up height of the spring piece 52 can be formed higher and molding property of the spring piece 52 having a desired strong spring property can be reliably improved with a high accuracy.

Figure 10:
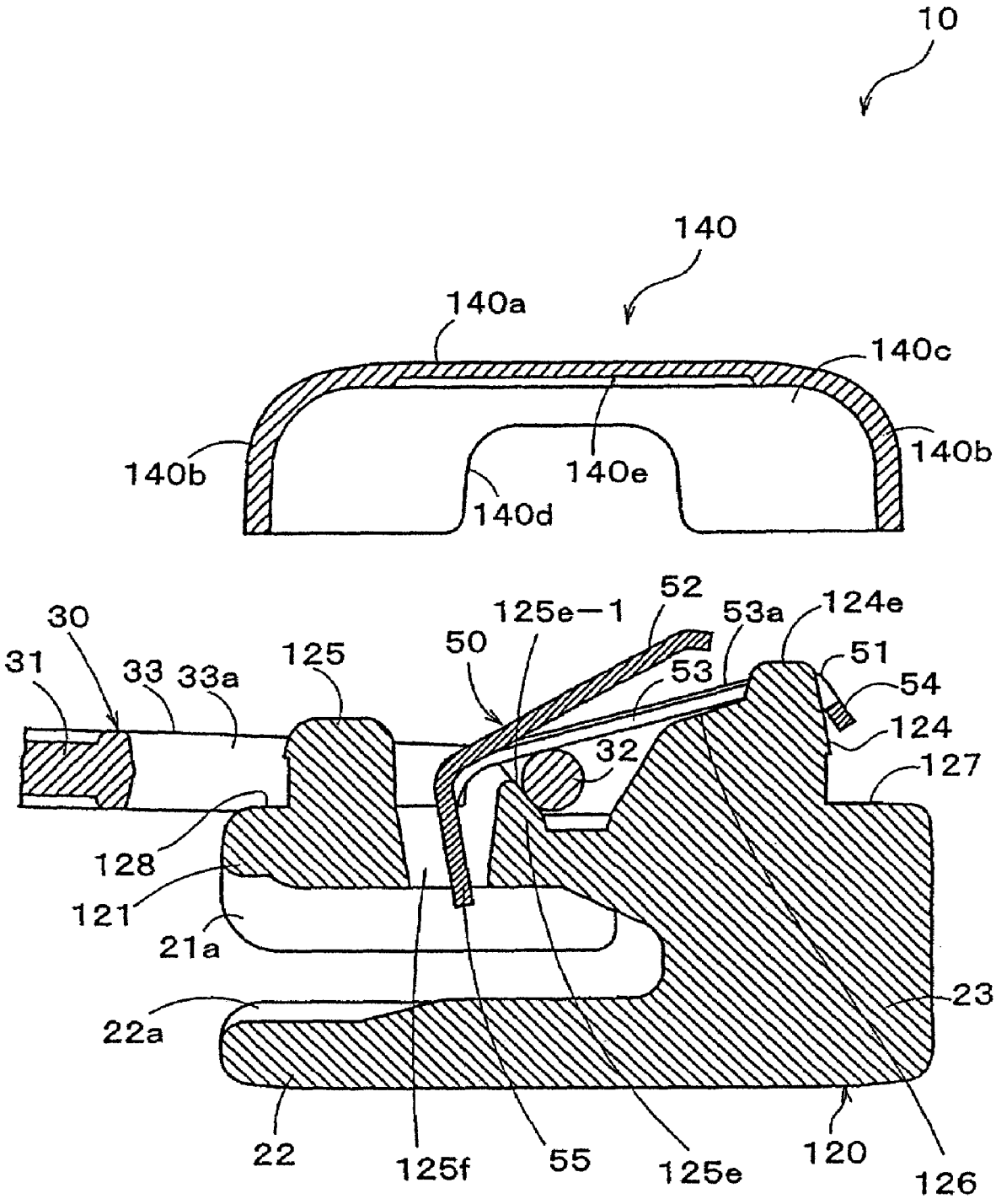
FIG. 10 is a major part longitudinal sectional view showing an assembling procedure for the slider on which the spring body shown in FIG. 8 is mounted.
Figure 11:
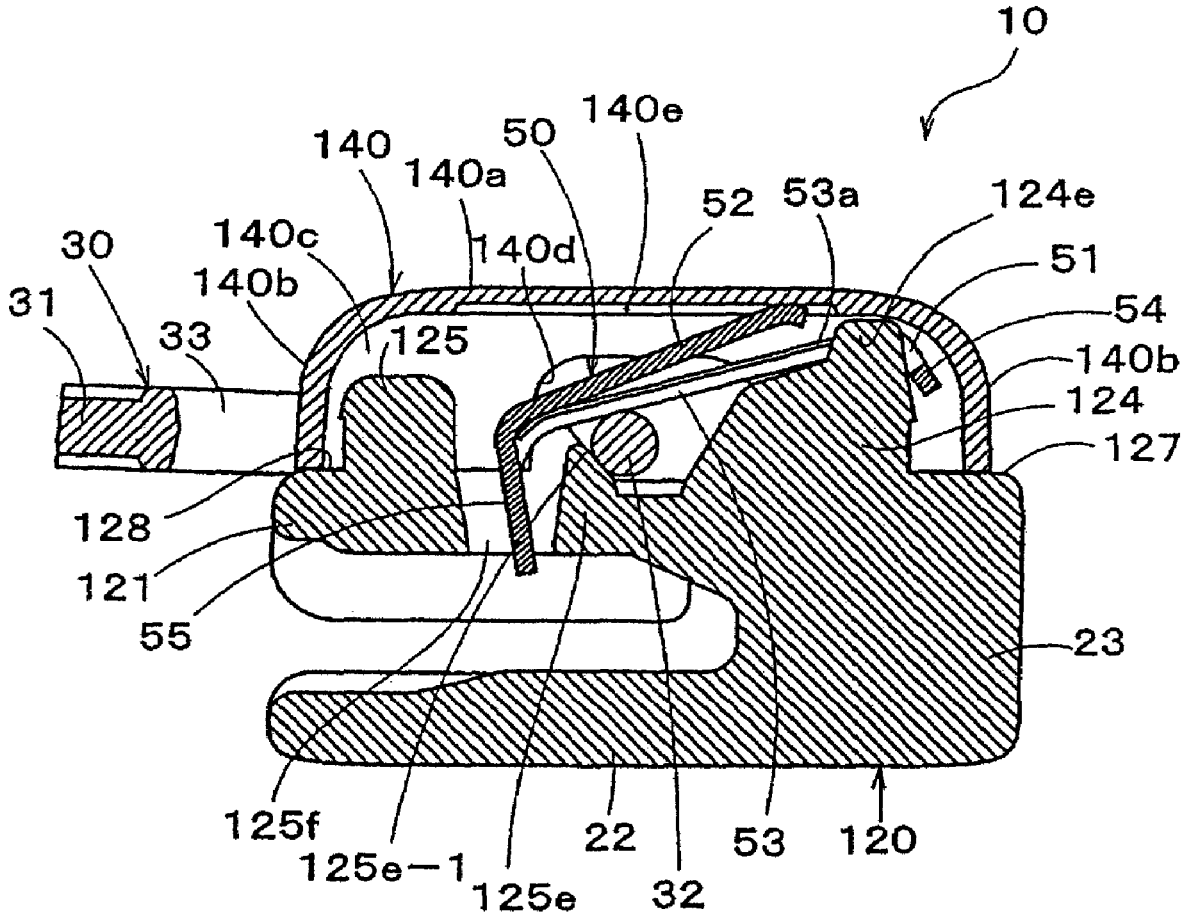
FIG. 11 is a major part longitudinal sectional view showing an inner structural example after assembling the slider.
Figure 12:
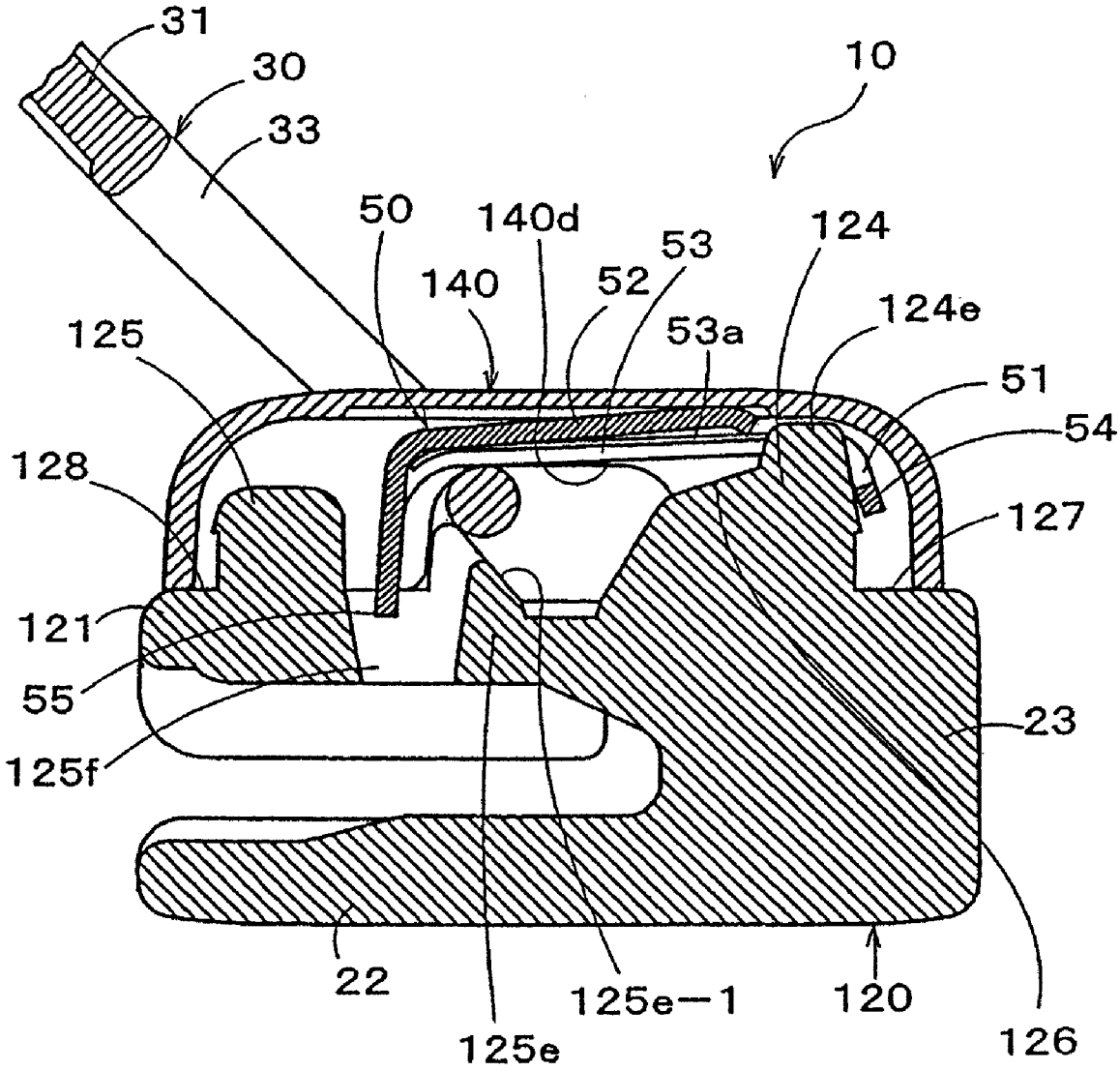
FIG. 12 is an explanatory view showing a state in which locking of the spring body of the slider is released.

Next, with reference to FIGS. 10 to 12, the inner structural example of the slider body 20 on which the spring body shown in FIGS. 8 and 9 is mounted will be described below. FIGS. 10 to 12 illustrate a second embodiment of the slider according to the invention. FIG. 10 is a major part longitudinal sectional view showing an assembling procedure for the slider, FIG. 11 is a major part longitudinal sectional view showing an inner structural example after assembling the slider, and FIG. 12 is an explanatory view showing a state in which locking of the spring body of the slider is released. In the meantime, in these drawings, the members that are substantially identical with the first embodiment are given the same member names and reference numerals as the first embodiment. Accordingly, the detailed explanation related to these members are herein omitted.

In these drawings, the present embodiment is largely different from the first embodiment in that the opening window portion 51 of the spring body 50 is fit in the projection piece portions 124*e* protruded on the top surface of the front end supporting post 124 to be supported thereon; and that the front and rear fitting posts 124 and 125 that are configured by the block body having a flat top surface are sealed as completely housed in the inside of the pull holding body 140. Accordingly, in place of the flat pull holding body, the pull holding body is configured by a rectangular box.

At a center of the top surface of the solid front fitting post 124 at the shoulder opening side of the slider (the right side in FIG. 10), the projection piece portions 124*e* is protruded, which is set vertically higher than the rear fitting post 125. On the rear wall surface of the front fitting post 124, a tapered face 126 for mounting a spring is formed as gradually inclined downward toward the rear opening side of the slider 10 from a root of the projection piece portions 124*e*. Therefore, it is possible to hold the spring body 50 solidly while making the fitting posture thereof stable.

On the lower portion of the front wall surface of the front fitting post 124, a stepped plane of a stepped portion 127 that is formed at the front end edge of the upper surface of the upper wing plate 121 is formed as a mounting face of the pull holding body 140 such that a gap is formed between the inner surface of the front platy portion of the pull holding body 140 and the front fitting post 124. The gap serves to make the operation of the spring body 50 disposed between the inner surface of the front platy portion of the pull holding body 140 and the front fitting post 124 easy as shown in FIGS. 11 and 12. On the lower portion of the rear wall surface of the solid rear fitting post 125 at the rear opening side of one slider (the left side in FIG. 10), the stepped plane of a stepped portion 128 that is formed at the rear end edge of the upper surface of the upper wing plate 121 is formed as a mounting face of the pull holding body 140.

On the lower portion of the rear wall surface of the front fitting post 124, a pull guide portion 125*e* is protruded lower than the rear fitting post 125. On the front end surface of the pull guide portion 125*e*, a pull guide surface 125*e*-1 for leading and guiding the pintle 32 of the pull 30 by the tapered face that is inclined downward step by step is formed. Further, between the rear proximal end of the pull guide portion 125*e* and the front proximal end of the rear fitting post 125, a rectangular pawl hole portion 125*f* is protruded through the upper blade piece 121 vertically, in which the pawl portion 55 of the spring body 50 is inserted and detached in and from the coupling element guide passage.

The pull holding body 140 is configured by a ceiling wall portion 140*a* formed approximately flat; front and rear side wall portions 140*b*, 140*b* which are formed on the back and forth of the ceiling wall portion 140*a* with their outer side surfaces bent in an arched-shape inwardly with the substantially same curvature; and a pair of right and left side wall portions 140*c*, 140*c* at the opposite sides for coupling the ceiling wall portion 140*a* and the front and rear side wall portions 140*b*, 140*b*. A space portion surrounded by the inner sides of the pull holding body 140 is sufficiently spacious to operate a portion of the pull 30 and the spring body 50. At the positions on the lower end edges of the right and left side wall portions 140*c* of the pull holding body 140 corresponding to the pintle 32 of the pull 30, concave cut-out portion 140*d* is formed. When the slider body 120 and the pull holding body 140 are engaged with each other, the concave cut-out portion 140*d* is separated from the upper surface of the upper blade piece 21, and a space portion for allowing the operation of the pintle 32 of the pull 30 is formed.

Further, at the position on the rear surface of the ceiling wall portion 140*a* corresponding to the spring piece 52 of the spring body 50, a concave groove portion 140*e* is formed. Since this ceiling wall portion 140*a* is formed thinner than the front and rear side wall portions 140*b*, 140*b*, when elastically deforming the spring piece 52 of the spring body 50, twist, damage and the like are prevented and the spring body 50 is not laterally slipped, so that it is possible to smoothly and reliably engage and detach the spring body 50 with and from the coupling element of the fastener chain (not shown).

Upon assembling the slider 10 configured as described above, as shown in FIG. 10, the insertion of the pull 30, the spring body 50, and the pull holding body 140 is not different from the first embodiment substantially. However, the present embodiment is different from the first embodiment in that the opening window portion 51 of the hook portion 54 of the spring body 50 is externally fit to the projection piece portions 124*e* of the front end supporting post 124 to be supported thereon; and that the pull holding body 140 completely contacts the spring body 50 to be fixed there against the elastic force of the spring piece 52 such that it wraps the front and rear fitting posts 124 and 125 from above the spring body 50. This pull holding body 140 is secured by conventionally well-known appropriate securing means. According to this securing means, for example, as same as the art disclosed in the above-described Japanese Patent Laid-Open Publication No. 10-127313, fitting a small projection element (not shown) that is protruded on the lower end surface of the rear side wall portion 140*b* of the pull holding body 140 into a concave groove (not shown) of the slider body 120, the right and left side wall portions 140*c*, 140*c* of the pull holding body 140 are crimped and fixed to the front and rear fitting posts 124 and 125.

FIG. 12 illustrates the operation for releasing locking of the pawl portion 55 of the spring body 50 from the state shown in FIG. 11. Upon releasing engagement between the pawl portion 55 of the spring body 50 and the coupling element (not shown), at first, as shown in FIG. 12, when pulling up the pull 30 mounted on the slider body 120 parallel thereto by hands, in connection to rising of the pintle 32 of the pull 30 along the pull guide surface 125*e*-1 of the pull guide portion 125*e*, the spring piece 52 of the spring body 50 is oscillated forward around the hook portion 54 of the spring body 50 that is externally fit by the projection piece portion 124*e* of the front fitting post 124 while elastically deforming the pawl portion 55 of the spring body 50 in a direction releasing engagement with the coupling element.

When the pintle 32 of the pull 30 moves to the movement limitation position of the spring body 50, as shown in FIG. 12, the pawl portion 55 of the spring body 50 is separated from the coupling element (not shown) via the pawl portion 125*f* of the upper blade piece 121 and then, the engagement state is released. Upon this release, the teeth of the fastener chain (not shown) can be coupled or they can be separated horizontally by freely sliding the slider 10 against the coupling element. If the pull 30 is released, the deformation against the elastic force of the spring piece 52 of the spring body 50 elastically returns to the original state, and the pawl portion 55 is automatically inserted between the coupling elements of the fastener chain via the pawl portion 125*f* of the upper blade piece 121 so as to maintain the slider 10 in a stopped state. Thus, by cutting out the longitudinal center portion of the platy material outward from the end portion at the side of the main body of the opening window portion 51, it is possible to effectively use the most versatile spring body 50 having the spring piece 52 that is bent more than one step and is cut out and pulled up at a predetermined height in various sliders.

According to the above-described respective embodiments, the spring body 50 is assembled in such a manner that the entire spring body 50 is held on the slider body 20 or 120 with being inclined downward from the opening window portion 51 to the side of the pawl portion 55. Therefore, a space portion can be acquired between the rear surface of the pull holding body 40 or 140 and the front post portions 24, 25, or 124, 125 of the slider body 20 or 120, which is sufficiently spacious to allow the operation of the pintle 32 of the pull 30 and the spring body 50. Thus, the interior portions of the pull holding bodies 40 and 140, and the slider bodies 20 and 120 can be effectively used, so that the excellent external design corresponding to the outline shape of the slider bodies 20 and 120 can be acquired and the commercial value of the slider can be sufficiently improved.

The preferable embodiments of the invention are described as above. For example, unlike as described above, it is not necessary to provide all of the chamfered portions 53*a* formed at the ridge line portions at the rising sides of the spring piece 52 of the cut-out hole 53 of the platy material, and the tapered faces 52*a* formed at the both side end portions of the spring piece 52 as the spring body 50 having the substantially rectangular opening window portion 51 at one end portion of the platy material, which is entirely formed in a substantially lateral C-shaped. In addition, it is a matter of course that the objects of the invention can be sufficiently achieved by any of the chamfered portion 53*a* and the tapered face 52*a* or arbitrary combinations thereof in relation to other causes such as the material, the length and the width of the spring body 50, the figuration and the size of the spring piece 52*a*, and the like. Accordingly, it is natural that the invention is not limited to the respective embodiments and the modified embodiments, and the design of the invention can be variously changed within the scope of respective claims.

What is claimed is:

1. A slider for a slide fastener, the slider comprising:

a slider body for coupling and releasing tooth rows of a fastener chain;

a pull holding body which is supported and fixed on an upper surface of the slider body and holds a pull moveably between the pull holding body and the upper surface of the slider body; and a spring body made of a flat platy material and supported and fixed on the upper surface of the slider body, wherein the spring body comprises a spring piece having a free end and a fixed end, an opening window portion at one end side of the spring body adjacent the free end of the spring piece, and an end portion at an other side of the spring body that is formed integrally with the fixed end of the spring piece, wherein the end portion formed integrally with the fixed end of the spring piece further has a pawl portion, wherein:

the spring piece is elastically disposed between the pull and a rear surface of the pull holding body, the spring body further defines a cut out hole extending longitudinally between the fixed end of the spring piece and the opening window portion, the spring piece being movable about its fixed end through the cut out hole, wherein the cut out hole has a first width and the opening window portion has a second width that is larger than the first width, and the pawl portion of the spring body is configured to be engaged with and released from a portion of the tooth rows of the fastener chain through the inside of the slider body on the basis of an elastic deformation of the spring piece by operating the pull.

2. The slider for the slide fastener according to claim 1, wherein lateral both side end surfaces of the spring piece are formed in tapered faces which are contracted step by step toward to a front end thereof.

3. The slider for the slide fastener according to claim 1, the spring body further comprising chamfered portions which are inclined in a direction in which ridge line portions at rising sides of the spring piece of a cut-out hole formed by cutting out the spring piece outward are approached with each other.

4. The slider for the slide fastener according to claim 1, wherein:

the slider body has first and second post portions on back and forth on the upper surface of the slider body; and the pull holding body comprises a substantially lateral C-shaped cover body having front and rear wall portions that are formed back and forth of a flat upper wall portion, and inner surfaces at the front end portions of the respective wall portions have engaging pieces to be elastically engaged with locked portions that are formed in the post portions.

5. The slider for the slide fastener according to claim 4, wherein the pull holding body has right and left blade pieces that are protruded from right and left of the upper wall portion downward to cover and seal a space portion between the first post portion and the second post portion.

6. The slider for the slide fastener according to claim 5, wherein the pull holding body has notch portions at proximal end portions of the right and left blade pieces, and projection portions formed at the post portions are fit and engaged with the notch portions.

7. The slider for the slide fastener according to claim 4, wherein the slider body has support walls that are built at right and left end edges of the first and second post portions and at least front and rear end portions of the pull holding body are fit and supported therein; and an end portion at a side of the pawl portion of the spring body and the end portion at an opposite side thereof are fit between the right and left support walls.

8. The slider for the slide fastener according to claim 7, wherein the spring body has a hook portion bending at one end thereof, the hook portion is hooked at a projection piece portion that is formed between the right and left support walls of the first post portion, and the end portion at the side of the pawl portion of the spring body is disposed lower than a side of the hook portion and is entirely inclined.

9. The slider for the slide fastener according to claim 1, wherein:

the slider body has first and second post portions on back and forth on the upper surface of the slider body, the pull holding body is composed of a rectangular box having a ceiling wall portion, front and rear side wall portions, and right and left side wall portions on which a notch is formed at its center portion, the pull holding body is externally fit in the first and second post portions of the slider body, and the pull holding body is secured on the upper surface of the slider body and seals the upper surface.

10. The slider for the slide fastener according to claim 9, wherein the slider body comprises a projection piece portion at an upper portion of the first post portion, the projection piece portion is made to freely fit in the opening window portion of the spring body to be hooked thereon, and the other end portion at the side of the pawl portion of the spring body is disposed lower than a side of the opening window portion and is entirely inclined.

* * * * *